US009126206B2

(12) United States Patent
Hartmann et al.

(10) Patent No.: US 9,126,206 B2
(45) Date of Patent: Sep. 8, 2015

(54) SEPARATING DEVICE FOR SEPARATING A MIXTURE

(75) Inventors: Werner Hartmann, Weisendorf (DE); Günter Lins, Erlangen (DE); Bernd Trautmann, Erlangen (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 13/582,730

(22) PCT Filed: Feb. 18, 2011

(86) PCT No.: PCT/EP2011/052409

§ 371 (c)(1),
(2), (4) Date: Sep. 4, 2012

(87) PCT Pub. No.: WO2011/107353

PCT Pub. Date: Sep. 9, 2011

(65) Prior Publication Data

US 2012/0325728 A1 Dec. 27, 2012

(30) Foreign Application Priority Data

Mar. 3, 2010 (DE) ..... 10 2010 010 220

(51) Int. Cl.
*B03C 1/23* (2006.01)
*B03C 1/253* (2006.01)
*B03C 1/28* (2006.01)

(52) U.S. Cl.
CPC ..... *B03C 1/253* (2013.01); *B03C 1/288* (2013.01); *B03C 2201/18* (2013.01)

(58) Field of Classification Search
CPC ..... B03C 1/00; B03C 1/23; B03C 1/24; B03C 1/0335; B03C 1/253; B03C 1/288; B03C 2201/18
USPC ..... 209/39, 213, 223.1, 224, 225–227, 232; 210/222, 223
See application file for complete search history.

(56) References Cited

U.S. PATENT DOCUMENTS 2,678,729 A * 5/1954 Spodig ..... 210/222
3,142,008 A * 7/1964 Kajihara ..... 335/217

(Continued)

FOREIGN PATENT DOCUMENTS

FR 2491782 A1 4/1982 ..... B03C 1/253
GB 2014062 A 8/1979 ..... B03B 5/44

(Continued)

OTHER PUBLICATIONS

Ghebremskel, A.N., et al. "A Continuous, Hybrid Field-Gradient Device for Magnetic Colloid-Based Separations," Journal of Magnetism and Magnetic Materials, 2003, Bd. 261, Nr. 1-2, 7 pages, Sep. 6, 2002.

(Continued)

*Primary Examiner* — Joseph C Rodriguez
(74) *Attorney, Agent, or Firm* — Slayden Grubert Beard PLLC

(57) ABSTRACT

A separating device for separating a mixture of magnetizable and non-magnetizable particles contained in a suspension that is conducted in a separating channel is provided, the separating device including a laminated, ferromagnetic yoke arranged to one side of the separating channel, e.g., a yoke made of iron, having at least one magnetic field generating means for generating a magnetic deflecting field and a separating element arranged at the outlet of the separating channel for separating the magnetic particles, wherein the magnetic field generating means is a coil assembly including coils equidistantly arranged in grooves of the yoke along the separating channel and which can be actuated via a control device such that a temporally variable deflecting magnetic field, substantially deflecting toward the yoke, e.g., a traveling wave, is generated, having substantially field-free regions passing over the entire length of the separating channel.

18 Claims, 7 Drawing Sheets

(56) References Cited

U.S. PATENT DOCUMENTS

| | | | | |
|---|---|---|---|---|
| 3,294,237 | A | 12/1966 | David | 209/214 |
| 3,394,807 | A * | 7/1968 | Fritz et al. | 209/219 |
| 4,306,970 | A * | 12/1981 | Tanaka et al. | 210/222 |
| 4,395,746 | A * | 7/1983 | Tanaka et al. | 361/143 |
| 6,277,275 | B1 * | 8/2001 | Yoshifusa et al. | 210/222 |
| 8,684,185 | B2 * | 4/2014 | Ries | 209/227 |
| 8,715,494 | B2 * | 5/2014 | Danov et al. | 210/143 |
| 2013/0087505 | A1 * | 4/2013 | Danov et al. | 210/695 |
| 2013/0256233 | A1 * | 10/2013 | Danov et al. | 210/695 |
| 2013/0327693 | A1 * | 12/2013 | Goraj | 210/141 |

FOREIGN PATENT DOCUMENTS

| | | | | |
|---|---|---|---|---|
| GB | 2333978 | A | 8/1999 | B03C 1/24 |
| JP | 57053258 | A | 3/1982 | B03C 1/23 |
| SU | 1105474 | A1 | 7/1984 | B03C 1/00 |

OTHER PUBLICATIONS

International Search Report and Written Opinion, Application No. PCT/EP2011/052409, 10 pages, May 19, 2011.

Australian Office Action, Application No. 2011223104, 2 pages, Feb. 12, 2014.

* cited by examiner

SEPARATING DEVICE FOR SEPARATING A MIXTURE

CROSS-REFERENCE TO RELATED APPLICATIONS

This application is a U.S. National Stage Application of International Application No. PCT/EP2011/052409 filed Feb. 18, 2011, which designates the United States of America, and claims priority to DE Patent Application No. 10 2010 010 220.2 filed Mar. 3, 2010. The contents of which are hereby incorporated by reference in their entirety.

TECHNICAL FIELD

This disclosure relates to a separating device for separating a mixture as per the precharacterizing clause of claim 1.

BACKGROUND

A plurality of methods for separating such a mixture of magnetizable and non-magnetizable particles are known and are briefly outlined here. Such methods are essentially based on the magnetic force that acts on magnetizable particles when a magnetic field gradient is present.

In known discontinuous methods, magnetizable isolation bodies such as iron wires, iron fibers or iron plates featuring surface structures such as slots or knobs, etc. in an external magnetic field generate a strong field gradient in their surroundings, wherein during an isolation phase said field gradient retains the magnetic particles of a suspension that flows past. In a second phase, the magnetic portion thus enriched is washed away in a subsequent rinsing step while the magnetic field is turned off. This method is disadvantageously discontinuous and requires the rinsing step.

In all known continuous methods, use is ultimately made of disadvantageous mechanically moving parts (for larger magnetizable particles in particular), wherein e.g. a magnet generates a magnetic field gradient on a surface of a rotating hollow cylinder, a disc or a conveyor belt. As a result of the movement, the surface travels beyond the magnetic field, such that the magnetizable portion then falls off or is stripped off. Separation of iron from refuse is one such example. The limited permissible distances between the magnet and the isolation surface represent a further disadvantage of these methods.

It was recently proposed, by means of a planar or cylindrical magnetic field generating means, to use a gradient field that deflects magnetizable particles toward at least one surface of a separating channel, such that magnetizable particles in a suspension flowing parallel with the magnetic field generating means in the separating channel are attracted and describe a path that is closer to the magnetic field generating means. A separated non-magnetic and magnetic material flow should then emerge via panels at the outlet. However, this approach is disadvantageous in a number of respects, since magnetic field and therefore magnetic force likewise are naturally stronger as a function of proximity to the field generating means, and therefore particles that are distant from the magnetic field generating means are deflected little, yet particles that are close to the magnetic field generating means are magnetically retained on the surface even despite the hydrodynamic forces of the flow. The separating effect is therefore reduced, and a rinsing step must also be used here to recover the magnetic portion after the magnetic field is turned off.

SUMMARY

In one embodiment, a separating device for separating a mixture of magnetizable and non-magnetizable particles is provided, wherein said separating device features a separating channel that is delimited on one side by a ferromagnetic yoke and on the other side by a magnetizable delimiting body, wherein provision is made for at least one magnetic field generating means for generating a magnetic field and a separating element that is arranged at the outlet of the separating channel and is used for separating out the magnetizable particles, wherein a coil assembly is provided as a magnetic field generating means and comprises coils that are arranged along the separating channel in grooves of the yoke and can be so actuated by a control device as to produce a temporally variable magnetic field that essentially deflects toward the yoke and travels along the separating channel.

In a further embodiment, at least some of the field lines of the magnetic field run from the yoke to the delimiting body. In a further embodiment, at least some of the field lines run perpendicularly relative to the separating channel. In a further embodiment, a width of the separating channel is less than two and a half times an internal width between two magnetic poles. In a further embodiment, the width of the separating channel is less than one and a half times the internal width between two magnetic poles. In a further embodiment, essentially field-free regions are provided along the yoke. In a further embodiment, a specific number of coils, in particular 12, along the separating channel of consecutive coils are combined in each case to form a period group, wherein the coils of a group can be actuated using the alternating current profile featuring at least one zero-current time segment, said actuation being staggered in each case by a portion, corresponding to the number of coils, of the period duration of an alternating current profile. In a further embodiment, a whole-number quantity of period groups is provided over the length of the separating channel. In a further embodiment, the alternating current profile in each case features two half-waves having a length of one quarter period duration interrupted by two zero-current time segments having a length of one quarter period duration in each case. In a further embodiment, the half-wave is a sinusoidal half-wave and/or a trapezoidal half-wave and/or a triangular half-wave. In a further embodiment, the control device comprises a converter which is frequency-variable in particular, is also designed for phase displacement, and has outlets representing half the number of coils. In a further embodiment, coils that are separated by half the number of coils in each case are electrically connected in such a way that every second coil can be exposed to current in a reverse direction in each case, the coil assembly being actuated via connection interfaces, the number of which corresponds to half the number of coils.

In a further embodiment, a cylindrical coaxial displacement body is arranged in a cylindrical hollow space that passes through the yoke, thereby forming the separating channel. In a further embodiment, the cylindrical coaxial yoke is arranged in a cylindrical hollow space that passes through an external body, thereby forming the separating channel. In a further embodiment, a device is provided for generating a tangential circular flow, in particular oblique inlet nozzles and/or a mixer and/or in particular oblique panels that are arranged within the separating channel. In a further embodiment, the coils are designed as annular surrounding solenoid coils. In a further embodiment, a protective wall which covers the grooves in the direction of the separating channel is provided.

BRIEF DESCRIPTION OF THE DRAWINGS

Example embodiments will be explained in more detail below with reference to figures, in which.

DETAILED DESCRIPTION

Figure 1:
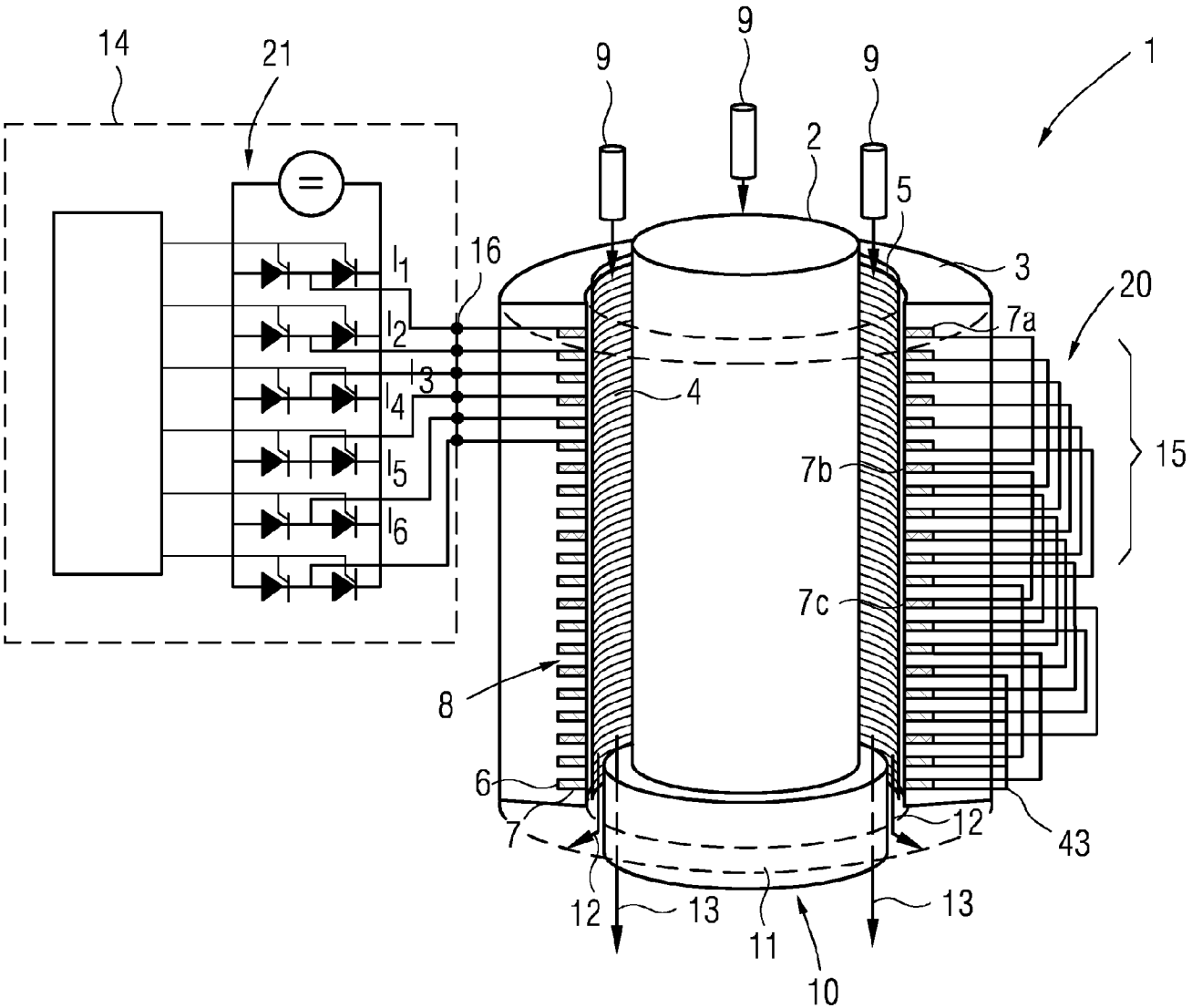
FIG. 1 shows a schematic diagram of a first example separating device according to one embodiment.

Some embodiments provide a separating device which allows a continuous and effective separating process in respect of a mixture comprising magnetizable and non-magnetizable particles.

For example, a separating device for separating a mixture of magnetizable and non-magnetizable may include a separating channel that is delimited on one side by a ferromagnetic yoke and on the other side by a magnetizable delimiting body. The separating device may further include at least one magnetic field generating means for generating a magnetic field, and a separating element that is arranged at the outlet of the separating channel and is used for separating out the magnetizable particles. A coil assembly that is arranged along the separating channel in grooves of the yoke is provided as a magnetic field generating means. The coil can be so actuated by a control device as to produce a temporally variable magnetic field that essentially deflects towards the yoke and travels along the separating channel.

In particular, as a result of making the displacement body from a readily magnetizable material such as a ferrite or pure iron or transformer plate material or comparable materials, instead of from a magnetically inert material, the magnetic field lines develop predominantly in a radial direction rather than having an axial orientation. The fluid volume that is penetrated by a magnetic field having a predominantly radial orientation increases significantly as a consequence. In this case, it is advantageous in particular if a separating channel width, i.e. the distance between the delimiting body (or the displacement body) and the yoke of the electromagnets is no more than two and a half times the coil height and/or an internal width between two magnet iron poles.

Unlike certain conventional devices, which make use of a constant magnetic field or at least (in the case of alternating current) a constant force distribution in the direction of the magnetic field generating means, such that a rinsing step is necessary, the present disclosure now proposes to configure the deflecting magnetic field in a temporally variable manner, thereby generating essentially (except for small flux leakage fields of low magnitude) field-free regions, in which no magnetic field gradient therefore exists to exert a force. These field gaps travel along the entire separating channel at a predetermined speed and preferably in the same direction as the flow of the suspension that is to be separated. This has the advantage that a magnetic particle which adheres by virtue of the deflecting magnetic field to that side wall of the separating channel which is oriented towards the yoke, briefly no longer senses a field at a specific time point when the essentially field-free region passes its position, can detach itself from the side wall of the separating channel again, and is transported onward by the hydrodynamic forces. Embodiments disclosed herein may therefore ensure that deposits of magnetizable particles do not occur on that side of the separating channel which is oriented toward the yoke, since the particles can detach themselves again in the field-free regions. However, there is no danger that the magnetizable particle which has just detached itself should drift too far away from the yoke, since the field-free region travels onwards and therefore the particle soon senses a deflecting force in the direction of the yoke again due to the deflecting magnetic field. It may therefore be possible in a continuous mode to avoid the disadvantageous rinsing step of certain conventional techniques and to achieve a continuous separation of magnetizable and non-magnetizable particles that are present in the suspension, this being effected by the separating element which separates the magnetic fraction that is transported close to the yoke. This also results in a significant time saving, since the suspension can be continuously supplied to the separating device, and no cost is involved in, e.g., the execution of the rinsing step and the associated supply of a carrier liquid that is free of particles, etc.

Such an embodiment of the temporally variable deflecting magnetic field is achieved by means of a coil assembly comprising coils that are in particular equidistantly arranged in grooves along the separating channel. These coils are actuated by a control device. They are exposed to an electrical current in a temporally variable manner in this case, thereby generating the corresponding deflecting magnetic fields and the substantially field-free regions, wherein in particular those coils at which an essentially field-free region is to be generated can be set to receive zero current.

In one embodiment, a specific number of consecutive coils, e.g. 12, may be provided along the separating channel to be combined in each case to form a period group, wherein the coils in a group can be actuated using the alternating current profile featuring at least one zero-current time segment, said actuation being staggered in each case by a portion, corresponding to the number of coils, of the period duration of an alternating current profile. It is particularly advantageous in respect of the interconnection in this case if a whole-number quantity of period groups is provided over the length of the separating channel. An alternating current profile featuring at least one zero-current time segment is therefore provided (in particular stored within the control device) for the actuation of the coils. This alternating current profile featuring the zero-current time segment has a specific period duration. It is repeated after this. The control device then actuates the coils of the coil assembly such that their operation is staggered in each case by a portion of the period duration of the alternating current profile, said portion corresponding to the number of coils, meaning that for a number of coils equal to 12, for example, each consecutive coil is actuated in a manner that is staggered by 1/12 of the period duration. In this example, there are always 11 coils that are actuated in a staggered manner between two coils which are exposed to current at the same time.

In a further embodiment, the current profile can in each case comprise two half-waves having a length of one quarter period duration interrupted by two zero-current time segments having a length of one quarter period duration in each case. Such an alternating current profile is easy to generate, wherein the half-wave can be a sinusoidal half-wave or a trapezoidal half-wave or a triangular half-wave. Instead of a normal alternating current actuation, zero-current time segments having the same length as the corresponding half-waves therefore exist whenever the current would reach a value of 0 anyway. A traveling wave with gaps is formed thus, wherein two instances of three consecutive coils will always receive a zero current at a specific time point if 12 coils are used in a period group. In addition to the essential effect according to embodiments disclosed herein, whereby the passage of the traveling wave allows the isolated particles in the essentially field-free region to detach themselves again and be transported onward a certain distance by the hydrodynamic forces of the suspension flow, this embodiment has the additional enhancement that on both sides of the deflection field maxima that are determined by the maximum of the half-wave, field gradients exist that are practically parallel with the separating channel wall, where the particles experience a force toward or in the direction of the separating element. This assists the transport of the magnetic portion along the wall of the separating channel in the direction of the outlet, without said magnetic portion becoming remixed with the volume of the suspension. Moreover, the direction of the deflecting magnetic field rotates at a position when the traveling wave passes. A rotational moment is therefore exerted on the magnetic particles, such that the magnetic particles also rotate. This facilitates the repeated detachment of the isolated particles in the essentially field-free region and counteracts the fusion and agglomeration into larger particles.

In order to allow a simple actuation of the coil assembly by the control device when using an alternating current profile, the control device may comprise a converter that is frequency-variable in particular, is also designed for phase displacement, and has outlets representing half the number of coils. Suitable converters are known, wherein a frequency-variable converter having 6 outlets may be used in the context of 12 coils per period group, for example. Said converter could comprise, e.g., two conventional 3-phase converters with suitably adapted actuation of the inverter bridges.

In one embodiment, coils that are separated by half the number of coils in each case can be electrically connected such that every second interconnected coil can be exposed to current in a reverse direction in each case, wherein the coil assembly is actuated via connection interfaces, the number of which corresponds to half the number of coils. In this way, the same current flows through identically positioned coils of consecutive period groups. Like the pattern of the deflection field, the current pattern likewise repeats itself after half a period length in each case, but in a reversed current direction. If there are 12 coils per periodicity group, for example, every sixth coil is electrically connected in series for this purpose, the current direction being reversed in each case. In this way, six individually actuated coil groups are formed. This results in a current distribution, along the coil stack, that is known from the winding techniques of three-phase motors and generators and generates the desired traveling field. The outlets of the last 6 coils are all electrically connected in a "star point". In the context of three-phase technology, this connection is known as a star connection, though the known delta connection is also possible.

With regard to a general geometric embodiment of the separating device, cylindrical and planar embodiments may be provided. According to a first design format of the separating device disclosed herein, a cylindrical, coaxial displacement body may be arranged in a hollow space that passes through the yoke, thereby forming the separating channel. Alternatively, the cylindrical coaxial yoke may be arranged in a cylindrical hollow space that passes through an external body, thereby forming the separating channel. Embodiments are therefore provided in which the yoke delimits the separating channel internally or externally, said separating channel being annular in cross-section. However, a design format having an internally arranged yoke may be advantageous if a device is provided for generating a tangential circular flow, in particular oblique inlet nozzles and/or a mixer and/or in particular oblique panels that are arranged within the separating channel. A circular flow is then generated such that the centrifugal forces move the non-magnetic particles toward the outer wall of the outer body, the inwardly acting force of the deflecting magnetic field prevailing over the magnetizable particles. Better separation and greater purity of the end product are achieved thus. In the case of a cylindrical design format, it is generally effective for the coils to be embodied as annular surrounding solenoid coils.

In a second, planar design format of the separating device disclosed herein, the essentially rectangular separating channel may be delimited on one side by the yoke, this featuring a planar surface. However, it should be noted at this point that in principle all geometrically effective embodiments and layouts can be used for the separating channel and the yoke. In an embodiment comprising a rectangular separating channel and the yoke adjoining on one side, so-called racetrack coils can be used in particular, wherein (unlike the cylindrical design format) the turns do not run completely along the separating channel, but run in overhangs along the side of the yoke which faces away from the separating channel. In one embodiment, the separating channel may be inclined in a flow direction, e.g., by 10°-90° relative to the vertical if a yoke is used as an upper limit of the separating channel. As a result of the oblique setting and the upwardly oriented magnet system, the force of gravity is advantageously utilized to improve the separating effect, since the non-magnetizable particles fall to the lower side of the separating channel due to the force of gravity, while the magnetizable particles are attracted upward due to the deflecting magnetic field.

It is generally effective to provide a protective wall which covers the grooves in the direction of the separating channel, such that the suspension cannot enter the grooves and reach the coils. The protective wall, which can be connected to the other walls forming the separating channel, thus forms the isolation surface that is oriented toward the yoke and in whose direction the deflecting force acts.

A panel can be used as a separating element, separating the stream of magnetizable particles that is transported on the side facing toward the yoke from the non-magnetizable particles.

The actual size and embodiment of the separating device may depend on the parameters that are to determine its performance, and primarily therefore on the throughput that is to be achieved. However, it can be stated generally that the separating channel width should be less than or close to the range of the deflecting magnetic field, wherein the deflecting magnetic field decreases exponentially in the case of a traveling wave, for example, and therefore the separating channel width should be less than or close to the decay length.

FIG. 1 shows a first exemplary embodiment of a separating device 1. It comprises a delimiting body in the form of a cylindrical displacement body 2, which is surrounded at a distance by a coaxial cylindrical laminated yoke 3 of iron. A separating channel 4 is therefore produced between the displacement body 2 and the yoke 3, and is separated by means of a protective wall 5 from the iron yoke 3 that delimits it externally. The iron yoke 3 further comprises circumferential grooves 6 which are oriented toward the separating channel 4 and in which solenoid coils 7 of a coil assembly 8 are equidistantly arranged, said solenoid coils 7 having turns that are circumferential, i.e. surround the separating channel 4.

A suspension which comprises, e.g., water as a carrier liquid and contains magnetizable and non-magnetizable particles is introduced continuously into the separating channel 4, e.g. by supply means that are indicated merely by 9 in this example. The purpose of the separating device 1 is to split these into a magnetic and a non-magnetic portion as the suspension flows continuously through the separating channel 4, this split being effected at the end of the separating channel 4 by means of a separating element 10, a panel 11 in this case, wherein the arrows 12 indicate the magnetic fraction and the arrows 13 indicate the non-magnetic portion.

The continuous operation of the separating device 1 can be achieved by injecting current into the coil assembly 8 in a specific manner, a control device 14 being used for this purpose. By means of a corresponding injection of current into the individual coils 7, a traveling wave is generated in the separating channel 4 as explained below, featuring gaps (i.e. field-free regions) which flow along the whole length of the separating channel 4.

Figure 2:
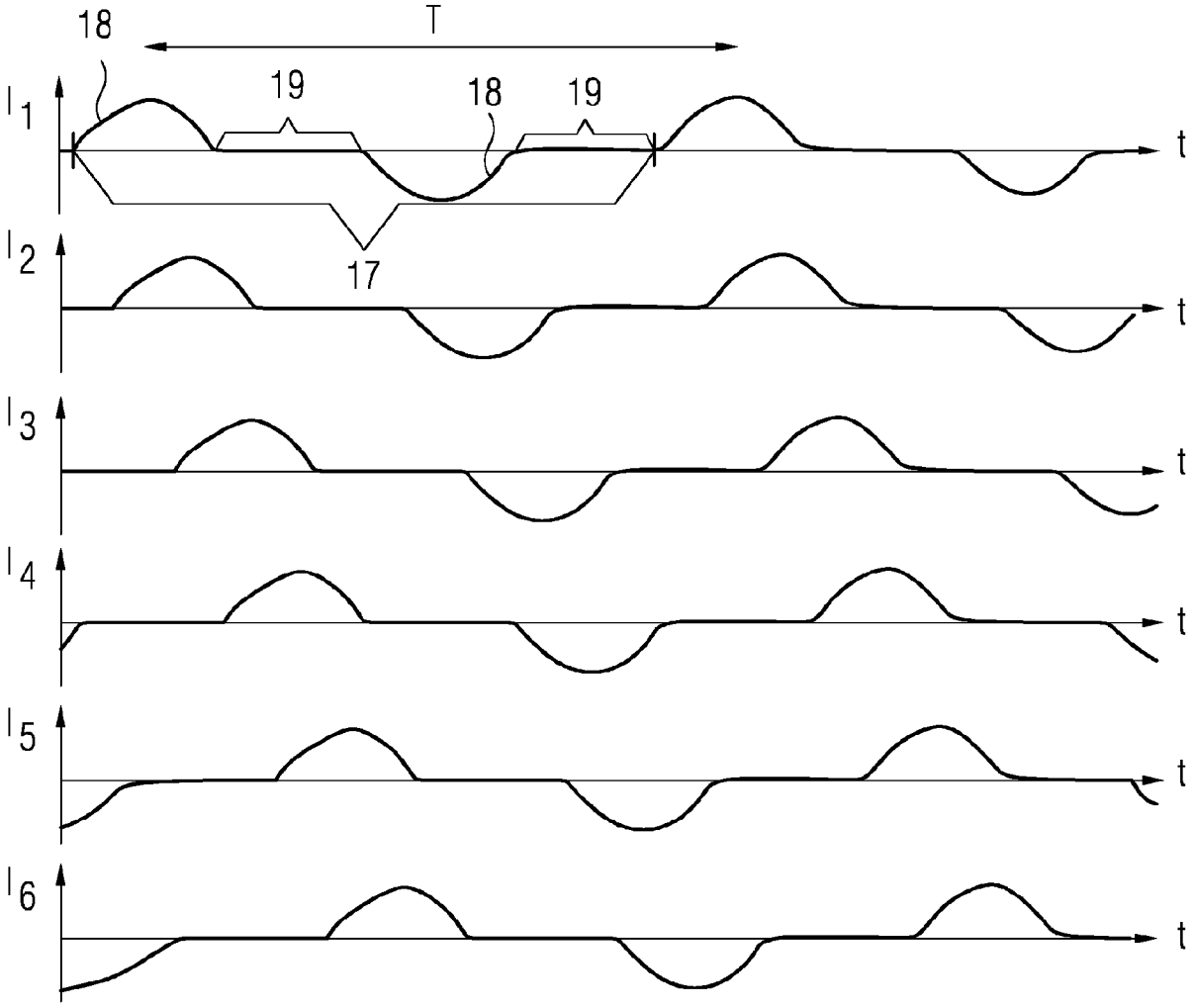
FIG. 2 shows the current profile and the graphs showing the staggered actuation.

For this purpose the coils 7, which number 36 in this case and for the sake of clarity are not all illustrated, are divided into three period groups comprising a number of coils equal to 12 coils each, a period group being labeled 15 in the drawing. As explained below, only six connection interfaces 16 are required for actuating the 36 coils 7 of the coil assembly 8 by means of the control device 14, meaning that six input signals $I_1$ to $I_6$ are generated, which are explained below in greater detail with additional reference to FIG. 2.

The basis of the actuation by the control device 14 is a current profile 17 having a period duration of T and comprising two sinusoidal half-waves 18 which have a duration of T/4 in each case and are separated in each case by a zero-current time segment 19 having a duration of T/4 likewise. The coils 7 of a period group 15 are then actuated using the current profile 17, said actuation being staggered by T/12 in each case, thereby producing a traveling wave which has gaps, i.e. essentially field-free regions. The six actuating currents $I_1$ to $I_6$ are initially shown relative to time in FIG. 2 for this purpose. It can be seen that the current $I_2$ is shifted by T/12 relative to $I_1$, etc., thereby producing the traveling wave. These currents Ii to le are now supplied via the connection interfaces 16 to the first six coils 7 in each case, the remaining coils 7 of the coil assembly 8 being actuated as described below via corresponding connections labeled 20. Every sixth coil is connected in each case, such that the first coil is connected to the seventh, the seventh to the thirteenth, etc. Of the coils that are connected thus, every second coil is exposed to current in a reverse direction in this case. If the coil 7*a* receives the current signal $I_1$, for example, the connected seventh coil 7*b* receives the current signal $-I_1$, and the thirteenth coil 7*c* (already in the next period group 15) in turn receives the signal $I_1$, etc. It is thus possible using only six input signals to actuate all three coil groups 15 correctly for the purpose of generating a traveling wave. The outlets of the last 6 coils are all electrically connected in a star point 43.

For the purpose of generating the current signals $I_1$ to $I_6$, the control device 14 comprises a frequency-dependent converter 21 containing two conventional three-phase converters. It must be emphasized again at this point that the cited numbers of coils (twelve) and period groups (three) are merely exemplary values, and that the underlying concept can be transferred to other embodiments without difficulty.

Figure 3:
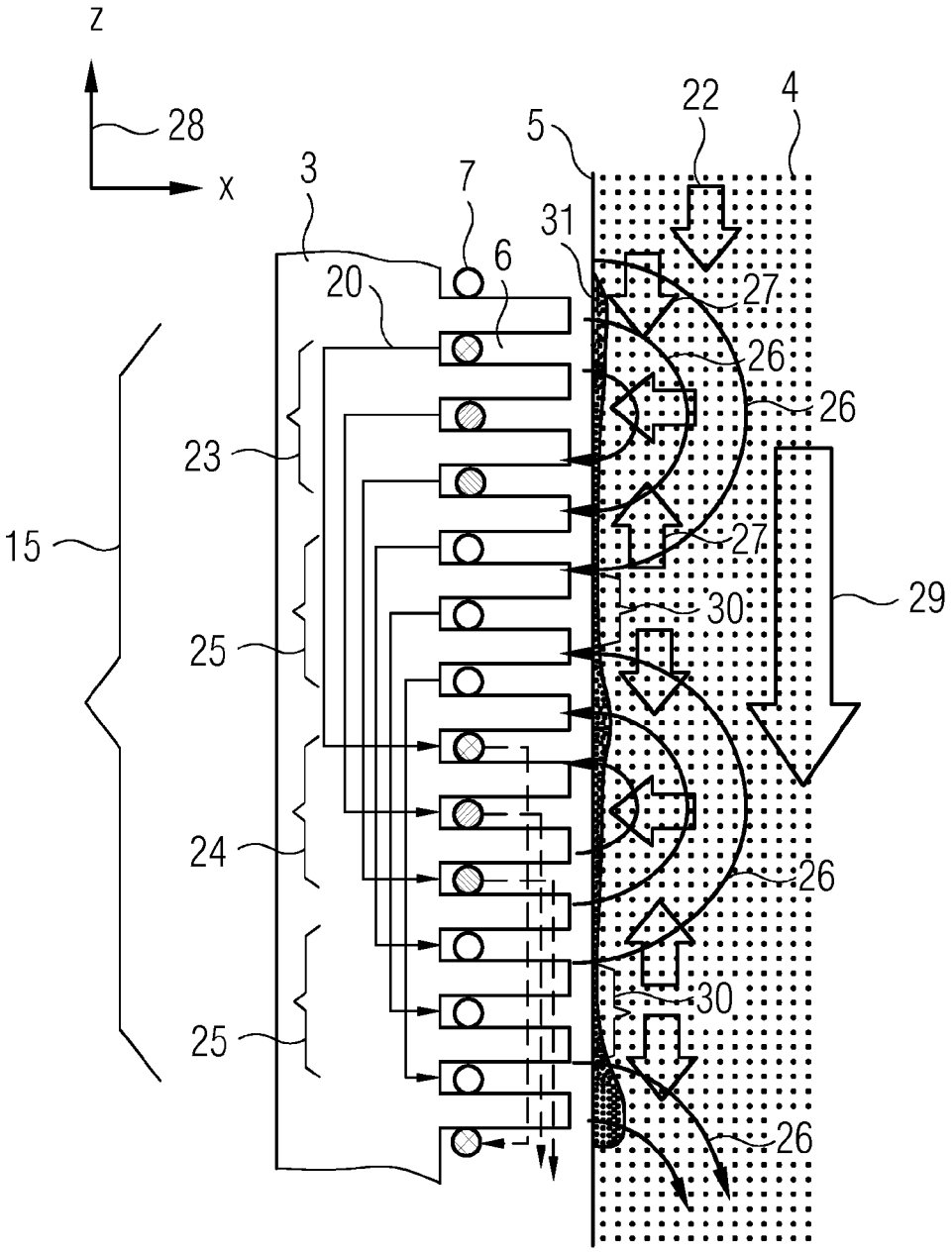
FIG. 3 shows a diagram that illustrates the traveling field and the directions of force.

FIG. 3 now shows the result of this actuation and interconnection of the coils with reference to a magnified period group 15. The iron yoke 3 is shown, with the coils 7 arranged in the grooves 6, and the connections 20 within the coil group 15, the protective wall 5 and the separating channel 4 through which the suspension flows as per the arrow 22. According to the corresponding actuation (cf. FIG. 2), three coils 7 of a coil group 15 are illustrated in each case as a group 23 through which current flows, a further group 24 of coils 7 is exposed to current in a reverse direction correspondingly, and two further groups 25, arranged between groups 23 and 24 that are exposed to current, receive zero current in the snapshot illustrated in FIG. 3. This actuation of the coils 7 produces a specific deflecting magnetic field, which is indicated here by the magnetic equipotential lines 26 marked in the separating channel. The arrows 27 indicate force components in a longitudinal direction (z-direction) and a radial direction (x-direction, cf. also system of coordinates 28). The arrow 29 shows the direction in which the generated deflecting magnetic field travels. The zero-current time segments clearly result in essentially field-free regions 30 which travel in exactly the same way, i.e. flow along the length of the separating channel 4. Finally, the magnetizable particles that are attracted to the protective wall 5 are labeled 31 in FIG. 3.

Figure 4:
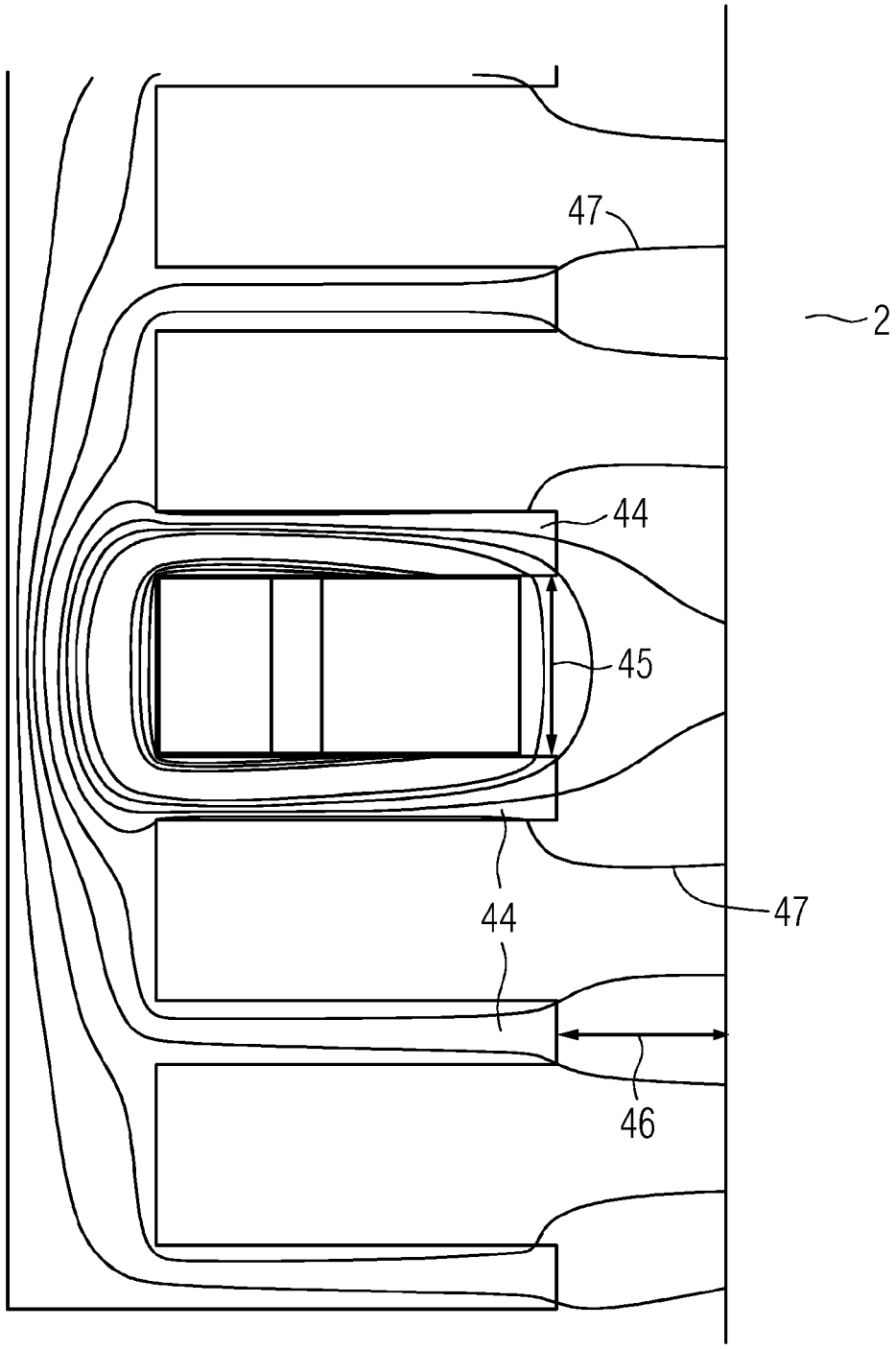
FIG. 4 shows a graphical representation of the course of the field and of the force components.

FIG. 4 shows the resulting field and force distribution in greater detail. The equipotential lines of the squared magnitude $B^2$ of the magnetic field are illustrated. Field lines 47 can be seen running almost perpendicularly relative to the separating channel 4, from the yoke 3 to the delimiting body (in the form of the displacement body 2 here). In the cylindrical embodiments according to FIGS. 1 and 5, the course of the field lines 47 is almost radial relative to the cylindrical yoke 3.

This perpendicular course relative to the separating channel 4 (or the large share of the perpendicular component of the magnetic field 9) can be attributed in particular to the delimiting body being made of a magnetizable material. Suitable materials for the delimiting body include e.g. ferrites, pure iron or transformer plate materials.

As a result of the described measure, the magnetic field lines 47 are mainly oriented perpendicularly relative to the separating channel 4, and not (as in the case of a non-magnetizable delimiting body) in an axial direction or along the separating channel. This in turn results in an increase in the fluid volume that is penetrated by radial field lines or field line components. This avoids the disadvantage of using magnetizable particles that are continuously transported in the direction of the increasing magnetic field on the basis of their inherent physical property. This means that the magnetizable particles and possibly attached particles or substances are continuously accelerated toward the magnet system, such that the greatest retaining force is always produced in the immediate vicinity of the magnet system, which can be disadvantageous to the method since the onward transport of particles is impeded.

As a result of using magnetizable delimiting bodies in the separating device, it is possible on the basis of comparable magnetic excitation to achieve significantly higher products of local field strength and field gradient than in the case of a delimiting body (e.g. displacement body 2) that is made of non-magnetic materials. It is therefore possible to achieve higher isolation rates and a significantly higher substance quantity throughput for the same structural dimensions and energy requirements.

The field and force ratios which are illustrated in FIGS. 3 and 4, and which move relative to time as shown, have the following significance in relation to the continuous separating process. As a result of the force components in an x-direction, magnetizable particles are deflected toward the yoke 3 and possibly accumulate there. Since the deflecting magnetic field decreases exponentially in the direction of the displacement body 2 as shown, the strong attracting forces close to the protective wall 5 can sometimes be stronger than the hydrodynamic force of the flow in this case, such that magnetizable particles 31 cannot initially be transported onward. The essentially field-free regions 30 now come into effect here, soon reaching such a magnetic particle by virtue of their own movement, such that the deflecting force temporarily disappears, the particle can detach itself and be transported some way further due to the hydrodynamic flow, before being retained against the protective wall 5 again by the x-component of the deflecting force of the next half-wave 18. This prevents the formation on the protective wall 5 of any deposits, which would be costly to remove in a subsequent rinsing step. The embodiment using a traveling wave comprising such zero-current time segments 19 has further advantages in addition to the z-components of the deflecting force. On both sides of the field maxima, there clearly exist gradients that are practically parallel with the wall, where the magnetizable particles experience a force toward or in the direction of the end of the separating channel 4. This assists the transport of the magnetic portion along the protective wall 5 in the direction of the outlet without said magnetic portion becoming remixed with the volume of the suspension. Moreover, the direction of the magnetic field at a specific position rotates relative to time when the traveling wave passes. A rotational moment is therefore exerted on the magnetic particles, such that these are also caused to rotate, thereby facilitating the repeated detachment of the isolated material in the essentially field-free region (i.e. the field gap) and counteracts the fusion and agglomeration into larger particles.

The pattern shown in FIGS. 3 and 4 continues periodically along the whole of the separating channel. A spatially and temporally periodic traveling wave is therefore produced in the cylindrical working space. Given a period duration T and a spatial repetition length or pole distance L, the traveling wave therefore moves at a speed of $v=L/T$. The range of the deflecting magnetic field and hence the magnetic force is shown as $x_0=L/2\pi$ in this case. The width of the separating channel 4 should be selected to be less than or close to xo.

The remaining parameters for a specific embodiment of the separating device 1 must be calculated with reference to the desired operating variables. By way of example, let it be given here that for a suspension volume flow of 200 $m^3$ per hour and a flow speed of 0.333 m per second, the separating channel can have a length of 1 m, for example. In the case of a protective wall diameter of 1.6 m, a separating channel width of 3 cm is provided. 12 coils are combined to form a period group in each case, e.g., for three period groups, i.e., 36 grooves. The period length can be 0.333 m and the groove size 14×60 $mm^2$ in this case. The frequency of the traveling wave is then 1 Hz in this exemplary embodiment.

Further characteristic variables of this specific exemplary embodiment are the copper current density of 5 $A/mm^2$ for a copper content of 75% and a current of 3000 A in the groove. Such a separating device would then require an electric power of 30 kW.

Figure 5:
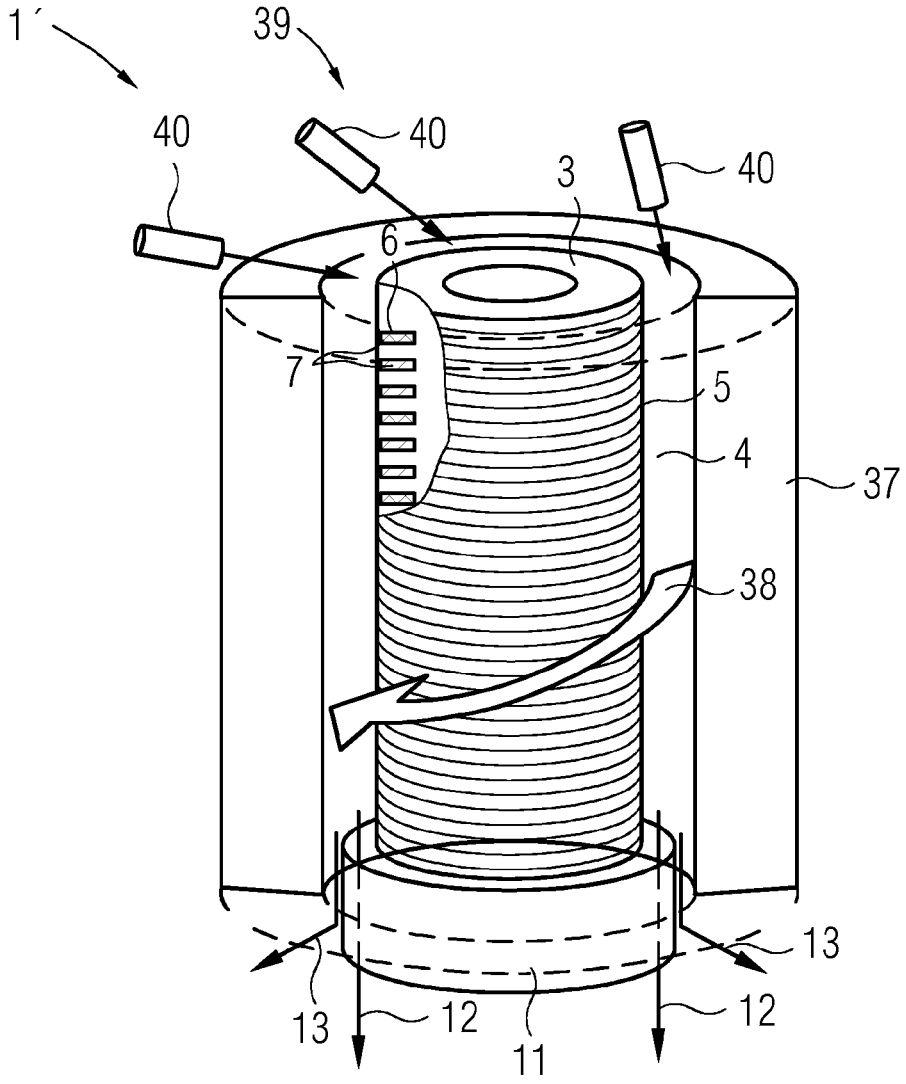
FIG. 5 shows a schematic diagram of a second example separating device according to another embodiment.

FIG. 5 is a schematic diagram of a second exemplary embodiment of a separating device 1', wherein for the sake of greater clarity identical components are denoted by the same reference signs both here and in the following. The laminated yoke 3 of iron, featuring the coils 7 in the grooves 6 (shown under the protective wall 5 as a cutout), is arranged internally here but is still designed as a cylinder and surrounded by a coaxial delimiting body in the form of a cylindrical external body 37, thereby forming the separating channel 4. Its functionality in respect of the generated traveling wave and the field-free regions is the same, and reference is therefore made to the first exemplary embodiment for discussion relating to this. The magnetic portion is now picked off internally relative to the panel, arrow 12, and the non-magnetic portion is picked off externally, arrows 13. In order to improve the separating effect, the suspension may be moved in a circular flow, this being indicated by the arrow 38. To this end, oblique inlet nozzles 40 may be used as a device 39 for generating the tangential circular flow. By virtue of the resulting centrifugal force, non-magnetizable particles are moved outward toward the external body 37, while the magnetic force resulting from the deflection field prevails over the magnetizable particles and they collect internally. The separating effect is improved thereby.

Figure 6:
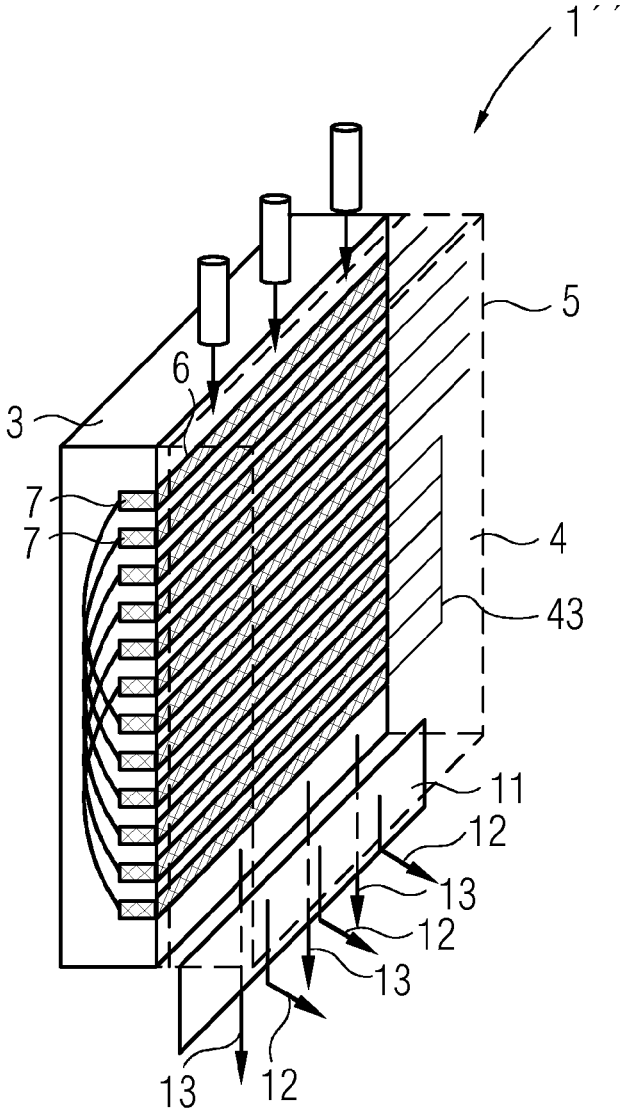
FIG. 6 shows a schematic diagram of a third example separating device according to another embodiment.

FIG. 6 shows a third exemplary embodiment of a separating device 1", which includes a rectangular separating channel 4 that is delimited behind a protective wall 5 on one side by the likewise rectangular yoke 3, this again comprising equidistant grooves 6 with coils 7 that are arranged therein. The coil conductors of the coils 7 run along the grooves, wherein racetrack coils can be used overall, but the coil conductors may continue via an overhang or through the interior of the iron yoke 3 after leaving a groove, such that they pass in the opposite direction through a groove 6 that is offset by half the number of coils, and so on. The corresponding periodicity is therefore achieved automatically. The coil is closed by means of a return into its first groove 6. However, the principle of the field generation and the traveling wave remains fundamentally identical to that in the first exemplary embodiment.

The removal of the magnetic and non-magnetic portion behind the panel 11 is illustrated again by the arrows 12 and 13.

Figure 7:
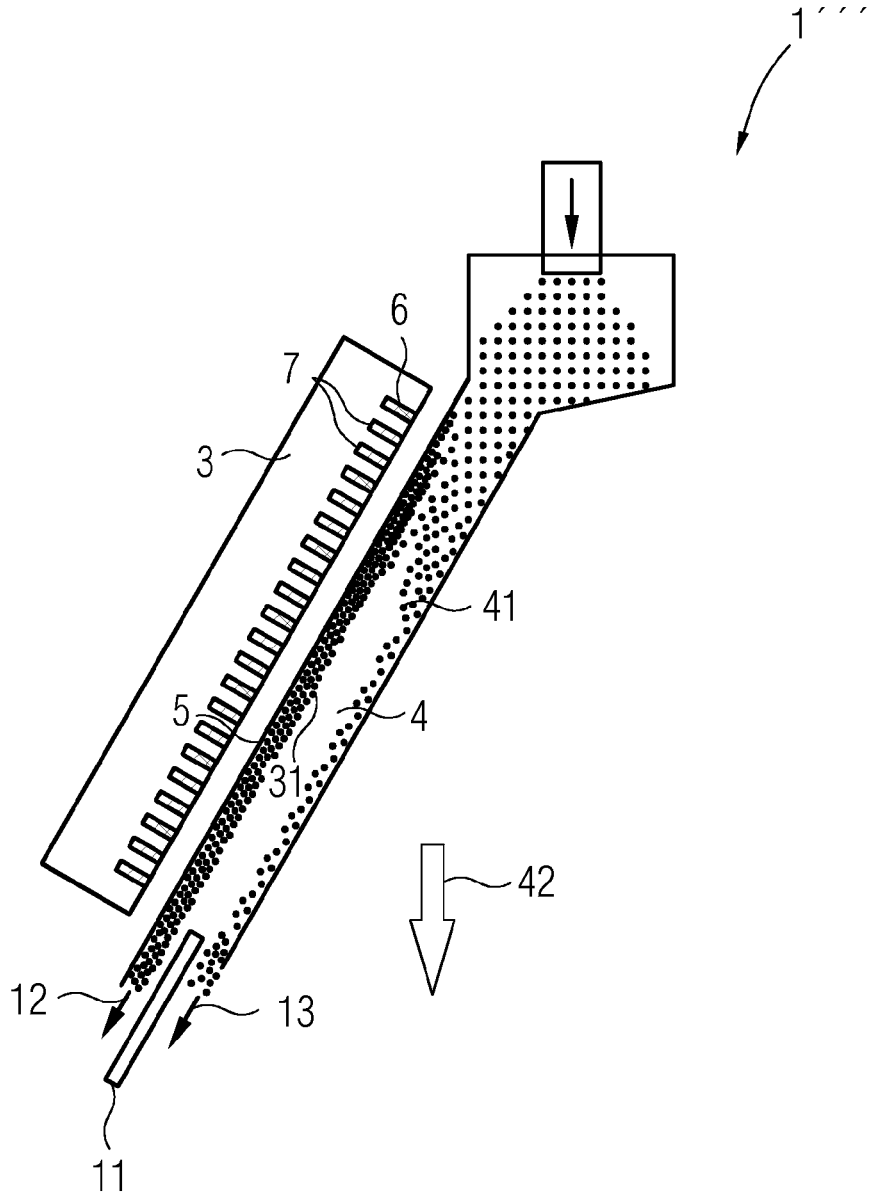
FIG. 7 shows a schematic diagram of a fourth example separating device according to another embodiment.

FIG. 7 finally shows a fourth exemplary embodiment of a separating device 1''' that corresponds essentially to that in FIG. 6, but nonetheless differs from the separating device 1" by virtue of the separating channel being set at an oblique angle of 30° relative to the vertical. As a result of this oblique setting, the force of gravity acts on the non-magnetizable particles 41 and removes them from the yoke 3 that is arranged on top, while the magnetizable particles 31 collect on the protective wall 5 facing the yoke 3 due to the stronger magnetic deflecting force. The effect of the force of gravity is indicated by the arrow 42. A better separating effect is again achieved in this case.

The removal of the relevant portions is again illustrated by the arrows 12 and 13 at the panel 11.

What is claimed is:

1. A separating device for separating a mixture of magnetizable and non-magnetizable particles, comprising:

a separating channel that is delimited on one side by a ferromagnetic yoke and on the other side by a magnetizable delimiting body, a separating element arranged at the outlet of the separating channel and configured to separate out the magnetizable particles, a coil assembly configured to generate a magnetic field, the coil assembly comprising coils arranged along the separating channel in grooves of the yoke, the coils being configured for actuation by a control device to produce a temporally variable magnetic field that essentially deflects toward the yoke and travels along the separating channel.

2. The separating device of claim 1, wherein at least some field lines of the magnetic field run from the yoke to the delimiting body.

3. The separating device of claim 1, wherein at least some field lines of the magnetic field run perpendicularly relative to the separating channel.

4. The separating device of claim 1, wherein a width of the separating channel is less than two and a half times an internal width between two magnetic poles.

5. The separating device of claim 4, wherein the width of the separating channel is less than one and a half times the internal width between two magnetic poles.

6. The separating device of claim 1, wherein essentially field-free regions are provided along the yoke.

7. The separating device of claim 1, wherein:

a specific number of coils along the separating channel of consecutive coils collectively form a period group, and the coils of a period group are configured for actuation using an alternating current profile comprising at least one zero-current time segment, said actuation being staggered by a portion, corresponding to the number of coils in the period group, of a period duration of the alternating current profile.

8. The separating device of claim 7, wherein a whole-number quantity of period groups is provided over the length of the separating channel.

9. The separating device of claim 7, wherein the alternating current profile features two half-waves having a length of one quarter period duration interrupted by two zero-current time segments having a length of one quarter period duration.

10. The separating device of claim 9, wherein the half-wave comprises at least one of a sinusoidal half-way, a trapezoidal half-wave, and a triangular half-wave.

11. The separating device of claim 1, wherein the control device comprises a frequency-variable converter configured for phase displacement and comprising outlets representing half the number of coils.

12. The separating device of claim 1, wherein coils that are separated by half the number of coils in each case are electrically connected in such a way that every second coil are exposed to current in a reverse direction, the coil assembly being actuated via a number of connection interfaces that corresponds to half the number of coils.

13. The separating device of claim 1, wherein a cylindrical coaxial displacement body is arranged in a cylindrical hollow space that passes through the yoke, thereby forming the separating channel.

14. The separating device of claim 1, wherein the cylindrical coaxial yoke is arranged in a cylindrical hollow space that passes through an external body, thereby forming the separating channel.

15. The separating device of claim 14, comprising a device configured to generate a tangential circular flow.

16. The separating device of claim 11, wherein the coils comprise annular surrounding solenoid coils.

17. The separating device of claim 1, comprising a protective wall that covers the grooves in the direction of the separating channel.

18. The separating device of claim 15, wherein the device configured to generate a tangential circular flow comprises at least one of oblique inlet nozzles, a mixer, and oblique panels arranged within the separating channel.

* * * * *